US012392083B2

(12) United States Patent
Brueckner et al.

(10) Patent No.: US 12,392,083 B2
(45) Date of Patent: Aug. 19, 2025

(54) DYED SUBSTRATE COMPRISING POLY(LACTIC ACID) FIBRES

(71) Applicant: ARAPAHA B.V., Maastricht (NL)

(72) Inventors: Tina Magdalena Rita Brueckner, Maastricht (NL); Johan Albert Frans Kunst, Maastricht (NL); Ernst-Jan Siewers, Alkmaar (NL); Narjes Shojai Kaveh, Maastricht (NL)

(73) Assignee: ARAPAHA B.V., Maastricht (NL)

( * ) Notice: Subject to any disclaimer, the term of this patent is extended or adjusted under 35 U.S.C. 154(b) by 0 days.

(21) Appl. No.: 18/716,976

(22) PCT Filed: Nov. 30, 2022

(86) PCT No.: PCT/EP2022/083898

§ 371 (c)(1),
(2) Date: Jun. 6, 2024

(87) PCT Pub. No.: WO2023/104610

PCT Pub. Date: Jun. 15, 2023

(65) Prior Publication Data

US 2025/0043506 A1 Feb. 6, 2025

(30) Foreign Application Priority Data

Dec. 7, 2021 (EP) ..... 21212766

(51) Int. Cl.
*D06P 3/00* (2006.01)
*D02G 3/02* (2006.01)
(Continued)

(52) U.S. Cl.
CPC ..... *D06P 3/54* (2013.01); *D02G 3/02* (2013.01); *D06P 1/16* (2013.01); *D06P 1/94* (2013.01);
(Continued)

(58) Field of Classification Search
CPC ..... D06P 3/54; D06P 1/16; D06P 1/94; D02G 3/02; D10B 2331/041; D10B 2401/063
(Continued)

(56) References Cited

U.S. PATENT DOCUMENTS 4,556,625 A * 12/1985 Lenox ..... D21H 21/28 8/402
4,680,033 A * 7/1987 Durl ..... D06P 5/12 8/604
(Continued)

FOREIGN PATENT DOCUMENTS

KR 20130069162 A * 6/2013 ..... C09B 67/008

OTHER PUBLICATIONS

Improving the Dyeability of Poly(lactic acid) Fiber Using N-phenylaminopropyl dated Aug. 17, 2025.*
(Continued)

*Primary Examiner* — Eisa B Elhilo
(74) *Attorney, Agent, or Firm* — B.V. Nederlandsch Octrooibureau

(57) ABSTRACT

Provided herein is a dyed substrate with at least 70 wt. % of dyed PLA-fibres having a poly(lactic acid) content of at least 70 wt. %, the dyed substrate having a total poly(lactic acid) content of at least 70 wt. %. The dyed PLA-fibres are dyed with one or more disperse dyes, and the dyed substrate has the following CIELAB colour: $0 \leq L^* \leq 25$; $-5 \leq a^* \leq 5$; and $-5 \leq b^* \leq 5$. A method of preparing the dyed substrate is also provided.

17 Claims, 1 Drawing Sheet

(51) Int. Cl.
*D06P 1/16* (2006.01)
*D06P 1/94* (2006.01)
*D06P 3/54* (2006.01)

(52) U.S. Cl.
CPC .. *D10B 2331/041* (2013.01); *D10B 2401/063* (2013.01); *D10B 2401/20* (2013.01)

(58) Field of Classification Search
USPC ..... 8/449
See application file for complete search history.

(56) References Cited

U.S. PATENT DOCUMENTS

2005/0217037 A1* 10/2005 Negola ..... D06P 1/0096 8/401
2007/0271710 A1 11/2007 Hosoda et al.
2008/0042312 A1* 2/2008 Chen ..... C08L 67/04 264/103

OTHER PUBLICATIONS

Dyeing of Polylactide fibers in supercritical carbon dioxide dated Apr. 27, 2007.*
Bach, E., Knittel, D. and Schollmeyer, E., 2006. Dyeing poly (lactic acid) fibres in supercritical carbon dioxide. Coloration technology, 122(5), pp. 252-258.
Baykuş, O., Davulcu, A. and Dogan, M., 2015. Improving the dyeability of poly (lactic acid) fiber using N-Phenylaminopropyl POSS nanoparticle during melt spinning. Fibers and Polymers, 16, pp. 2558-2568.
Xu, S., Chen, J., Wang, B. and Yang, Y., 2015. Sustainable and hydrolysis-free dyeing process for polylactic acid using nonaqueous medium. ACS Sustainable Chemistry & Engineering, 3(6), pp. 1039-1046.
Wen, H. and Dai, J.J., 2007. Dyeing of polylactide fibers in supercritical carbon dioxide. Journal of applied polymer science, 105(4), pp. 1903-1907.

* cited by examiner

DYED SUBSTRATE COMPRISING POLY(LACTIC ACID) FIBRES

TECHNICAL FIELD OF THE INVENTION

The present invention relates to a substrate comprising poly(lactic) acid fibres that have been dyed in a very deep shade of black with one or more disperse dyes.

The invention further provides a method of preparing a dyed substrate comprising poly(lactic) acid fibres that have been dyed in a very deep shade, said method comprising:

- providing a substrate comprising poly(lactic) acid fibres;
- introducing the substrate into a dyeing chamber;
- passing a stream of dyeing medium through the dyeing chamber containing the substrate, said dyeing medium comprising at least 80 wt. % of supercritical carbon dioxide, one or more disperse dyes and less than 3 wt. % water.

BACKGROUND OF THE INVENTION

Poly(lactic acid), or polylactide (PLA) is a thermoplastic polyester with backbone formula $[—C(CH_3)HC(=O)O—]_n$. PLA is obtained by condensation of lactic acid with loss of water or by ring-opening polymerization of lactide, the cyclic dimer of the basic repeating unit. PLA has become a popular material due to it being economically produced from renewable resources.

PLA polymers range from amorphous glassy polymer to semi-crystalline and highly crystalline polymer with a glass transition of 60-65° C., a melting temperature of 130-180° C., and a tensile modulus of 2.7-16 GPa. Heat-resistant PLA can withstand temperatures of 110° C. The basic mechanical properties of PLA are between those of polystyrene and PET.

Due to the chiral nature of lactic acid, distinct forms of PLA exist. The following forms of PLA have been used commercially:

- poly-(L-lactic acid), also referred to as PLLA, is the product resulting from polymerization of L,L-lactide
- poly-(D-lactic acid), also referred to as PDLA, is the product resulting from polymerization of
- poly-(DL-lactic acid), also referred to as PDLLA, is the product resulting from polymerization of a mixture of L- and D-lactide A PLA with a high melting temperature of up to 230° C. may be obtained by physically blending PLLA with PDLA due to the formation of a so-called stereo complex.

The widespread application of PLA has been hindered by physical and processing shortcomings. For instance, the hydrolytic degradation of poly(lactic acid) fibers under conventional aqueous dyeing conditions has so far seriously limited the application of PLA in the textile industry as it leads to a loss of strength and tenacity. PLA fibres are typically dyed using an aqueous dyeing medium containing disperse dye and having an acid pH in the range of 4.5 to 5.0, at a temperature of 110-115° C. for 15-30 minutes. The dyed fibres so obtained, however, suffer from poor rub and wash fastness. Furthermore, at temperatures in excess of 90° C., PLA shows high shrinkage in water.

Another open challenge associated with the dyeing of PLA fibres is realising deep shades of dark colours, notably deep shades of navy blue or black colours.

The so-called Kubelka-Munk theory has been widely applied to describe the depth of colour of a dye on a textile substrate. This has proved a valuable tool to dye users and dye manufacturers and has allowed an objective assessment of the depth of a particular shade of dye on textile substrates. According to the Kubelka-Munk theory the K/S value is indicative of colour depth and is calculated on the basis of the following equation:

$$K/S = (1 - R_\infty)^2/2R_\infty;$$

K is the absorption coefficient;

S is the scattering coefficient;

$R_\infty$ is the reflectance of the surface having such a thickness that there is no further change in the reflectance by increasing the thickness Xu et al. (*Sustainable and Hydrolysis-Free Dyeing Process for Polylactic Acid Using Nonaqueous Medium*, CS Sustainable Chem. Eng. 2015, 3, 6, 1039-1046) describe a process for dyeing poly(lactic acid) using liquid paraffin as a non-aqueous dyeing medium at dyeing temperatures of 80 to 140° C. Disperse Blue 56 and Disperse Blue 79 were tested. The K/S values reported did not exceed 15.64.

US 2007/0271710 relates to disperse dyes that are capable of providing good light fastness to poly(lactic acid) based fibers. The examples of the US patent application describe dyeing of PLA fibres using an aqueous dye bath at 110° C. for 30 minute.

US 2008/0042312 describes a deep-dyeable modified PLA fiber, comprising: a modified PLA composition which includes PLA and a modifying polymer, wherein said modifying polymer is a polyester selected from the group consisting of an aliphatic polyester other than PLA, an aromatic polyester, and an aliphatic-aromatic copolyester, and wherein said modified PLA composition, when dyed, provides a decreased L-value compared to a non-modified PLA composition that is dyed under the same dyeing conditions as said modified PLA composition and that contains said PLA but is free of said modifying polymer. The examples of the US patent application describe dyeing of the modified PLA fiber in an aqueous dyeing medium at 110° C. for 40 minutes.

Wen et al. (*Dyeing of Polylactide Fibers in Supercritical Carbon Dioxide*, Journal of Applied Polymer Science, Vol. 105, 1903-1907 (2007)) explored the possibility of dyeing PLA fibers in SC—$CO_2$ and to investigate the effect of dyeing conditions on the mechanical properties of the fiber. Disperse Blue 79 was used in the study.

Bach et al. (*Dyeing poly(lactic acid) fibres in supercritical carbon dioxide*, Coloration Technology, Volume 122, Issue 5 p. 252-258 (2006)) conducted a study into the dyeing of poly(lactic acid) fibres in supercritical carbon dioxide. The authors conclude: "*As with water dyeing, deep shades of navy blue and black colours are still a limitation on PLA in scCO2 as can be seen by the K/S values in Figures* 3 *and* 4". The K/S values, after dyeing for 4 h without after clearing using the black and navy-blue dyes, were significantly lower than after dyeing of PLA for 1 h. Fibre damage and elongation at break in supercritical carbon dioxide were found to be similar to water.

Baykus et al. (*Improving the Dyeability of Poly(lactic acid) Fiber Using N-Phenylaminopropyl POSS Nanoparticle during Melt Spinning*, Fibers and Polymers (2015), Vol. 16, No. 12, 2558-2568) describe a study in which N-Phenylaminopropyl POSS Nanoparticle was applied during Melt Spinning of Poly(lactic acid) to improve dyeability. Dyeing experiments were conducted in an ordinary dyeing machine, using the following dyes: Disperse Blue 79, Disperse Blue 60 and Disperse Yellow 211.

SUMMARY OF THE INVENTION

The present inventors have found a way of dyeing PLA-fibres in a very deep colour shade, such as black or navy blue, using one or more disperse dyes.

One aspect of the present invention provides a dyed substrate comprising at least 70 wt. % of dyed PLA-fibres having a PLA content of at least 70 wt. %, the dyed substrate having a total PLA content of at least 70 wt. %, wherein the dyed PLA-fibres are dyed with one or more disperse dyes and wherein the dyed substrate has the following CIELAB colour:

$$0 \le L^* \le 25;$$

$$-5 \le a^* \le 5;$$

$$-5 \le b^* \le 5.$$

This CIELAB colour corresponds to a dark shade of black.

The inventors have unexpectedly discovered that substrates comprising PLA-fibres can be dyed in a very deep colour shade corresponding to the following CIELAB colour:

$$0 \le L^* \le 25;$$

$$-128 \le a^* \le 10;$$

$$-128 \le b^* \le 128;$$

by dyeing method comprising:

providing a substrate comprising at least 70 wt. % of fibres having a poly(lactic) acid content of at least 70 wt. %, said substrate having a total poly(lactic) acid content of at least 70 wt. %;

introducing the substrate into a dyeing chamber;

passing a stream of dyeing medium through the dyeing chamber containing the substrate during a period of 15 to 300 minutes to produce a dyed substrate, said dyeing medium having a pressure of 12-50 MPa and a temperature of 70-100° C., comprising at least 80 wt. % of supercritical carbon dioxide, one or more disperse dyes and less than 3 wt. % water;

wherein the disperse dye is employed in a concentration of 0.2-3% by weight of substrate;

wherein the dyeing conditions employed during the dyeing period meet the following condition:

$$W_{CO2}/W_{dye} \ge 100 \text{ kg/g}$$

wherein:

$W_{CO2}$ represents the total mass of supercritical dioxide that is passed through the dyeing chamber during the dyeing period, expressed in kg;

$W_{dye}$ represents the total amount of disperse dye that is retained in the dyed substrate after the dyeing period, expressed in g.

This CIELAB colour that is achieved by the present method correspond to a dark shades of blue, green and black.

The dyeing method of the present invention not only yields a dyed PLA-based substrate having a very deep colour shade, but the dyed substrate also exhibits an extremely good rub fastness and wash fastness. Although the inventors do not wish to be bound by theory, it is believed that the dyeing method of the present invention causes the PLA to swell considerably, allowing dyes to easily diffuse into the polymer. After supercritical dyeing, the dye is effectively trapped in the PLA-matrix. The deep penetration in combination with the effective fixation of the dye within the PLA-matrix contributes to colour intensity and the colour fastness of the dyed substrate.

The present dyeing method further offers the advantage that it has no adverse effect on the properties of the substrate as PLA-hydrolysis and substrate shrinkage are effectively minimized. Hydrolysis of PLA reduces the polymeric chain length which, in case of PLA-based fibres, is inherently associated with a loss of fibre tenacity that may render the fibres unsuitable for textile applications.

DETAILED DESCRIPTION OF THE INVENTION

Figure 1:
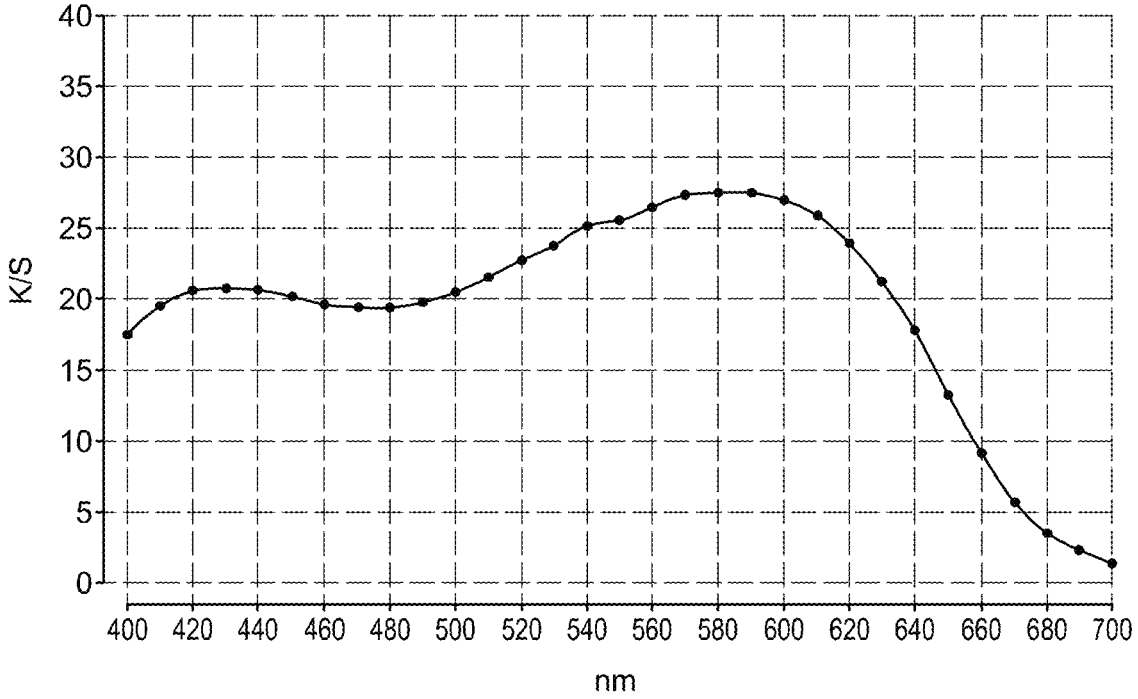
FIG. 1 shows the K/S curve of fabric made of filament PLA yarn, which fabric has been dyed black in accordance with the present invention using black using a mixture of disperse dyes.

A first aspect of the present invention relates to a dyed substrate comprising at least 70 wt. % of dyed PLA-fibres having a PLA content of at least 70 wt. %, the dyed substrate having a total PLA content of at least 70 wt. %, wherein the dyed PLA-fibres are dyed with one or more dyes and wherein the dyed substrate has the following CIELAB colour:

$$0 \le L^* \le 25;$$

$$-5 \le a^* \le 5;$$

$$-5 \le b^* \le 5.$$

The term "substrate" as used herein refers to fibres, filaments, yarns (e.g. yarns comprising continuous filament yarns as well as staple fibers), braids, fabrics, ropes and garments.

The term "fibre" as used herein refers to an elongated body having a length and transverse dimensions, wherein the length of the body is much greater than its transverse dimensions.

The fibre may have regular or irregular cross-sections. The fibre may also have a continuous length (filaments) or a discontinuous length (staple fibres).

The CIELAB colour space is a colour space defined by the International Commission on Illumination (abbreviated CIE) in 1976. It expresses colour as three values: L* for perceptual lightness, and a* and b* for the four unique colours of human vision: red, green, blue, and yellow. CIELAB colour space is device-independent and covers the entire range of human colour perception. The lightness value, L* defines black at 0 and white at 100. The a* value, which ranges from −128 to 128, describes the green-red opponent colours, with negative values toward green and positive values toward red. The b* value, which ranges from −128 to 128, describes the blue-yellow opponents, with negative numbers toward blue and positive toward yellow.

The so-called K/S value is a measure of the colour strength of a dyed substrate. The K/S value is calculated on the basis of the following equation:

$$K/S = (1 - R_\infty)^2/2R_\infty;$$

K is the absorption coefficient;

S is the scattering coefficient;

$R_\infty$ is the reflectance of the surface having such a thickness that there is no further change in the reflectance by increasing the thickness.

The K/S value can suitably be determined using a Data-Colour spectrophotometer under illuminant D65/10 degrees (outdoor daylight).

The dyed substrate of the present invention may suitably contain a combination of PLA fibres and other fibres, e.g. a combination of PLA fibres and one or more other fibres selected from natural cellulose fibres (e.g. cotton, flax or hemp), regenerated cellulose fibres (e.g viscose), wool fibres, silk fibres and synthetic fibers (e.g. polyester, polyamide-6, polyamide-6.6).

Preferably, the dyed substrate comprises at least 80 wt. %, more preferably at least 90 wt. % and most preferably at least 98 wt. % of fibres having a PLA content of at least 70 wt. %.

According to another preferred embodiment, the dyed substrate contains at least 70 wt. % of fibres having a PLA content of at least 80 wt. %, more preferably of at least 90 wt. % and most preferably of at least 98 wt. %.

The dyed substrate of the present invention preferably has a total PLA content of at least 80 wt. %, more preferably of at least 90 wt. %, even more preferably of at least 95 wt. % and most preferably of at least 96 wt. %.

The L* colour value of the dyed substrate of the present invention preferably does not exceed 20. More preferably, the L* colour value is in the range of 5 to 18, most preferably in the range of 10 to 18.

The substrate that has been dyed black preferably comprises a mixture of two or more different disperse dyes, more preferably a mixture of three or more different disperse dyes.

According to a particularly preferred embodiment, the maximum K/S value of the dyed substrate in the wavelength range of 400 to 700 nm is at least 20, more preferably 24-40, even more preferably 25-38 and most preferably 26-35.

The dyed substrate preferably has an average K/S value in the range of 540 nm to 640 nm of at least 20, more preferably of at least 22 and most preferably of 23 to 35.

According to a particularly preferred embodiment, the dyed substrate has an average K/S value in the range of 420 nm to 640 nm of at least 20, more preferably of at least 22 and most preferably of 23 to 35.

The dyed substrate preferably has a reflectance at 600 nm of less than 50%, more preferably of less than 25% and most preferably of less than 10%, the reflectance being determined by Spectrophotometer under Illuminant D65/10 degrees (outdoor daylight).

The dyed substrate of the present invention has a surprisingly good wet rub fastness. Preferably, the dyed substrate has a wet rub fastness of at least 4, more preferably 5, as determined by ISO 105-X12:2016.

The dyed substrate exhibits a good wash fastness. Preferably, the dyed substrate has a wash fastness of at least 4, more preferably 5, as determined by ISO 105-C06:2010.

The PLA that is contained in the dyed substrate preferably has a glass transition temperature of 55 to 65° C., more preferably of 55 to 65° C., as determined by differential scanning calorimetry.

According to a particularly preferred embodiment, the dyed substrate of the present invention comprises a PLA-yarn that contains the dyed PLA-fibres. Preferably, the PLA-yarn contains at least 80 wt. %, more preferably at least 90 wt. % of the dyed PLA-fibres. Most preferably, the PLA-yarn consists of dyed PLA-fibres.

The PLA-yarn in the dyed substrate preferably has a tensile strength of 10-50 cN/tex, more preferably of 12-45 cN/tex, as determined by ISO method 2062.

The PLA-yarn in the dyed substrate preferably has an elongation at break of less than 60%, more preferably of less than 55%, as determined by ISO method 2062.

The average molecular weight ($M_w$) of the PLA in the dyed substrate preferably is at least 50 kg/mol, more preferably in the range of 100-300 kg/mol and most preferably in the range of 120-280 kg/mol.

The melting point of the PLA in the dyed substrate preferably is at least 172° C., more preferably in the range of 173-240° C., most preferably in the range of 174-190° C.

According to a preferred embodiment, at least 98 wt. %, more preferably at least 99 wt. % of the PLA in the dyed substrate is poly-(L-lactic acid).

In accordance with a further preferred embodiment, the PLA in the substrate has a melt flow index (MFI) at 190° C., as determined by ISO method 1133-1:2011, of less than 12 g/10 min., more preferably of less than 8 g/10 min., most preferably of 1-6 g/10 min. The Melt Flow Index is a measure of the ease of flow of the melt of a thermoplastic polymer. It is defined as the mass of polymer, in grams, flowing in ten minutes through a capillary of a specific diameter and length by a pressure applied via prescribed alternative gravimetric weights for alternative prescribed temperatures.

Another aspect of the invention relates to a method of preparing a dyed substrate comprising at least 70 wt. % of dyed PLA-fibres having a poly(lactic) acid content of at least 70 wt. %, the dyed substrate having a total poly(lactic) acid content of at least 70 wt. %, wherein the dyed PLA-fibres are dyed with one or more disperse dyes and wherein the dyed substrate has the following CIELAB colour:

$$0 \le L^* \le 25;$$

$$-128 \le a^* \le 10;$$

$$-128 \le b^* \le 128,$$

said method comprising:

providing a substrate comprising at least 70 wt. % of fibres having a poly(lactic) acid content of at least 70 wt. %, said substrate having a total poly(lactic) acid content of at least 70 wt. %;

introducing the substrate into a dyeing chamber;

passing a stream of dyeing medium through the dyeing chamber containing the substrate during a period of 15 to 300 minutes to produce a dyed substrate, said dyeing medium having a pressure of 12-50 MPa and a temperature of 70-100° C., and comprising at least 80 wt. % of supercritical carbon dioxide, one or more disperse dyes and less than 3 wt. % water;

wherein the disperse dye is employed in a concentration of 0.2-3% by weight of substrate;

wherein the dyeing conditions employed during the dyeing period meet the following condition:

$$W_{CO2}/W_{dye} \geq 100 \text{ kg/g}$$

wherein:

$W_{CO2}$ represents the total mass of supercritical dioxide that is passed through the dyeing chamber during the dyeing period, expressed in kg;

$W_{dye}$ represents the total amount of disperse dye that is retained in the dyed substrate after the dyeing period, expressed in g.

The poly(lactic) acid and the PLA-fibres that are employed in the present method are preferably as specified herein before in relation to the dyed substrate of the present invention.

The a* colour value of the dyed substrate that is obtained by the present method is preferably in the range of −60 to 10, more preferably in the range of −20 to 5.

The b* colour value of the dyed substrate that is obtained by the present method is preferably in the range of −60 to 10, more preferably in the range of −40 to 5.

According to a preferred embodiment, the present method yields a substrate that is dyed black, said dyed substrate having an a* colour value in the range of −5 to 5 and a b* colour value in the range of −5 to 5.

According to another preferred embodiment, the present method yields a substrate that is dyed blue, said dyed substrate having an a* colour value in the range of −20 to 0 and a b* colour value in the range of −40 to −10.

In accordance with a preferred embodiment, in case |a*| and/or |b*| of the dyed substrate exceeds 10, the maximum K/S value of the dyed substrate in the wavelength range of 400 to 700 nm is at least 20, |a*| representing the absolute value of a* and |b*| representing the absolute value of b*.

According to a particularly preferred embodiment, the maximum K/S value of the dyed substrate in the wavelength range of 400 to 700 nm is at least 20, more preferably 24-40, even more preferably 25-38 and most preferably 26-35.

The dyed substrate preferably has an average K/S value in the range of 540 nm to 640 nm of at least 20, more preferably of at least 22 and most preferably of 23 to 35.

According to a particularly preferred embodiment, the dyed substrate has an average K/S value in the range of 420 nm to 640 nm of at least 20, more preferably of at least 22 and most preferably of 23 to 35.

Carbon dioxide preferably constitutes at least 90 wt. %, more preferably at least 95 wt. % of the dyeing medium that is used in the present method.

The dyeing medium preferably contains 2-5,000 mg/kg, more preferably 5-1,000 mg/kg and most preferably 20-300 mg/kg of the one or more disperse dyes.

The present method preferably employs a mixture of two or more different disperse dyes, more preferably a mixture of three or more different disperse dyes.

During the contacting of the substrate with the dyeing medium, the dyeing medium preferably has a pressure of 15-40 MPa, more preferably of 20-32 MPA.

During the contacting of the substrate with the dyeing medium, the temperature of the dyeing medium preferably is in the range of 75-95° C., more preferably in the range of 85-92° C.

In the present method the substrate is preferably contacted with the dyeing medium during 20-200 minutes, most preferably during 25-120 minutes.

In a particularly preferred embodiment of the present method tone or more disperse dyes are employed in a concentration of 0.3-2.5% by weight of substrate, more preferably in a concentration of 0.4-2% by weight of substrate.

Preferably, the dyeing conditions employed during the dyeing period meet the following condition: 200 kg/g≤$W_{CO2}/W_{dye}$≤10,000 kg/g. More preferably, the dyeing conditions employed during the dyeing period meet the following condition: 300 kg/g≤$W_{CO2}/(W_{dye})$ s 6,000 kg/g. Most preferably, the dyeing conditions employed during the dyeing period meet the following condition: 400 kg/g≤$W_{CO2}/(W_{dye})$≤4,000 kg/g.

The present method offers the advantage that it can be used to dye PLA without loss of molecular weight and consequent strength loss, making it possible to use the dyed PLA fibres in more demanding applications and/or to use PLA with a relatively low molecular weight.

Typically, in the present dyeing method, the average molecular weight ($M_w$) of the PLA is reduced by not more than 5%, more preferably by not more than 3% and most preferably by not more than 1%.

The water content of the dyeing medium preferably does not exceed 2 wt. %, more preferably it does not exceed 1 wt. % and most preferably it does not exceed 0.25 wt. % when the dyeing medium is contacted with the substrate.

In a preferred embodiment of the present method, the dyeing medium is produced by passing a stream containing at least 90 wt. % of supercritical carbon dioxide through a container holding disperse dye and subsequently passing a stream of the dyeing medium so obtained through the dyeing chamber. In an even more preferred embodiment, the stream of dyeing medium leaving the dyeing chamber is recirculated to the dyeing chamber via the container holding disperse dye.

After the dyeing period, the pressure within the dyeing chamber is preferably reduced at a depressurisation rate between 3 to 10 bar/minute, more preferably between 4 and 8 bar/minute and most preferable between 5 and 7 bar/minute.

According to a particularly preferred embodiment, the present dyeing method yields a dyed substrate as defined herein before.

The invention is further illustrated by the following non-limiting examples.

EXAMPLES

Example 1

The following substrates made of various types of PLA were subjected to a lab-scale dyeing trial:

1. Knitwear, ex TryMee, Czech Republic
2. Granulate, ex ITA, Germany (contains high melting point PLA)
3. Fabric (from bag), ex Trymee, Czech Republic
4. Fabric (from polo shirt), ex Trymee, Czech Republic
5. Staple fibre (33 tex/60 mm), ex Trevira, Germany
6. Staple fibre (6.6 dtex/60 mm), ex Trevira, Germany 7. Tape, ex Centexbel, Belgium (contains PLA L130 ex Total Corbion)
8. Fabric, ex Comfil, Denmark (contains both high melting and low melting PLA)
9. Industrial yarn (2200 dtex F120), ex Senbis, the Netherlands
10. Straws, ex USA
11. Spun yarn, ex Die Spinnerei, Neuhof GmbH, Germany All the above substrates were dyed using dyeing medium that consisted of supercritical carbon dioxide and Corangar Navy Blue (PE-3658). The dyeing medium had a pressure of 250 bar and a temperature of 90° C. Prior to the pressurisation, the substrates had been introduced in a dyeing chamber. During the dyeing period, the dyeing medium was continuously recirculated through a container holding the disperse dye, thereby ensuring that the dyeing medium was saturated with dissolved dye when it entered the dyeing chamber. The total amount of dye used was 0.7% by weight of substrate and the ratio $W_{CO2}/W_{dye}$ was 1967 kg/g.

All of the dyed substrates so obtained had an intense blue colour.

Example 2

Pieces of 'no stretch interlock' fabric (50×600 cm) made of PLA filaments yarn were subjected to pilot plant scale (100 L) dyeing trials. The dyeing medium consisted of supercritical carbon dioxide and Corangar Navy Blue (PE-3658) The dyeing trials were carried out at 250 bar and different temperature (100° C., 92° C. and 85° C.). The total amount of dye used was 0.7% by weight of fabric. The ratio $W_{CO2}/W_{dye}$ was 2130 kg/g After dyeing the length and width of the fabric samples was measured. The results are shown in Table 1.

TABLE 1

| Dyeing temperature | Length | Width |
|---|---|---|
| 100° C. | −9.4% | −8.3% |
| 92° C. | −5.1% | −0.6% |
| 85° C. | −7.1% | −6.95% |

Example 3

Two different rugs, both made of tufted PLA yarn (made from spun yarn ex die Spinnnerei Neuhof, produced from Luminy® L175, ex Total Corbion) were subjected to pilot plant scale dyeing trials. The dyeing medium consisted of supercritical carbon dioxide and Corangar Blue PE-3648 The dyeing trials were carried out at 250 bar and 90° C. The total amount of dye used was 0.5% by weight of fabric. The ratio $W_{CO2}/W_{dye}$ was 1010 kg/g.

Before and after dyeing the length and width of the rugs was measured. The results are shown in Table 2.

TABLE 2

| | Length (in cm) | | Width (in cm) | |
|---|---|---|---|---|
| | Before | After | Before | After |
| Rug 1 | 55.0 | 53.8 | 48.4 | 47.5 |
| Rug 2 | 64.0 | 63.5 | 60.0 | 59.5 |

Example 4

A yarn bobbin containing undyed yarn wound on a perforated hollow cylinder was subjected to pilot plant scale dyeing trials. The yarn (NM20 ex Die Spinnerei Neuhof, Germany) was made of PLA (Luminy® 175, ex Total Cobrion). The cylinder was made of polypropylene. The dyeing medium consisted of supercritical carbon dioxide and Corangar Blue (PE-3648). The dyeing trial was carried out at 250 bar and 90° C. The total amount of dye used was 0.5% by weight of fabric. The ratio $W_{CO2}/(W_{dye})$ was 1161 kg/g.

Before and after dyeing the dimensions of the cylinder (including yarn) were determined. The results are summarized in Table 3.

TABLE 3

| | PE-3648 | |
|---|---|---|
| | Before | After |
| Inside diameter of yarn bobbin (mm) | 78.7 | 77.4 |
| Outside diameter of yarn bobbin | 195.5 | 180.5 |
| Average length (mm) | 248.3 | 243.5 |
| Weight (grams) | 2617 | 2632 |
| Volume (liter) | 6.25 | 5.08 |
| Density (grams/liter) | 418.7 | 518.2 |

Example 5

The dyed and undyed yarns of Example 4 were subjected to a strength elongation test, using an electronic dynamometer "Zwick" 1511 (break time set 20 seconds) according to ISO 2062 and measured with 5 measurements per datapoint.

Tenacity=strength break(*g*)/count(*dtex*)

The results of the test are summarized in Table 4.

TABLE 4

| | Tenacity (in cN/dtex) |
|---|---|
| Undyed | 1.593 |
| Dyed with PE-3325 | 1.587 |
| Dyed with PE-3648 | 1.627 |

Example 6

Pieces of fabric made of filament PLA yarn were dyed using a dyeing medium consisting of supercritical carbon dioxide and the following mixture of disperse dyes to make a black shade (in total 1.5% by weight of fabric):

Corangar Yellow Brown PE 3325 (0.7% by weight)

Corangar Red PE 3499 (0.13% by weight)

Corangar Navy Blue, PE-3618 (0.2% by weight of fabric)

Corangar Blue, PE-3658 (0.47% by weight of fabric)

The ratio $W_{CO2}/W_{dye}$ that was employed was 1600 kg/g.

The weight averaged molecular weight of the PLA in the dyed and undyed fabric was determined by means of gel permeation chromatography. The results are summarized in Table 5.

TABLE 5

| | Weight averaged molecular weight ($M_w$) in kg/mol |
|---|---|
| Undyed | 93 |
| PE-3658 | 99 |
| PE-3648 | 100 |

Example 7

The CIELAB colour of the dyed fabrics Example 6 that had been dyed black or navy blue was determined. The results of the colour measurements are shown in Table 6.

TABLE 6

| | Navy Blue | Black |
|---|---|---|
| L* | 20.4 | 15.8 |
| a* | 9.1 | 2.1 |
| b* | −25.5 | −2.7 |

Example 8

Figure 2:
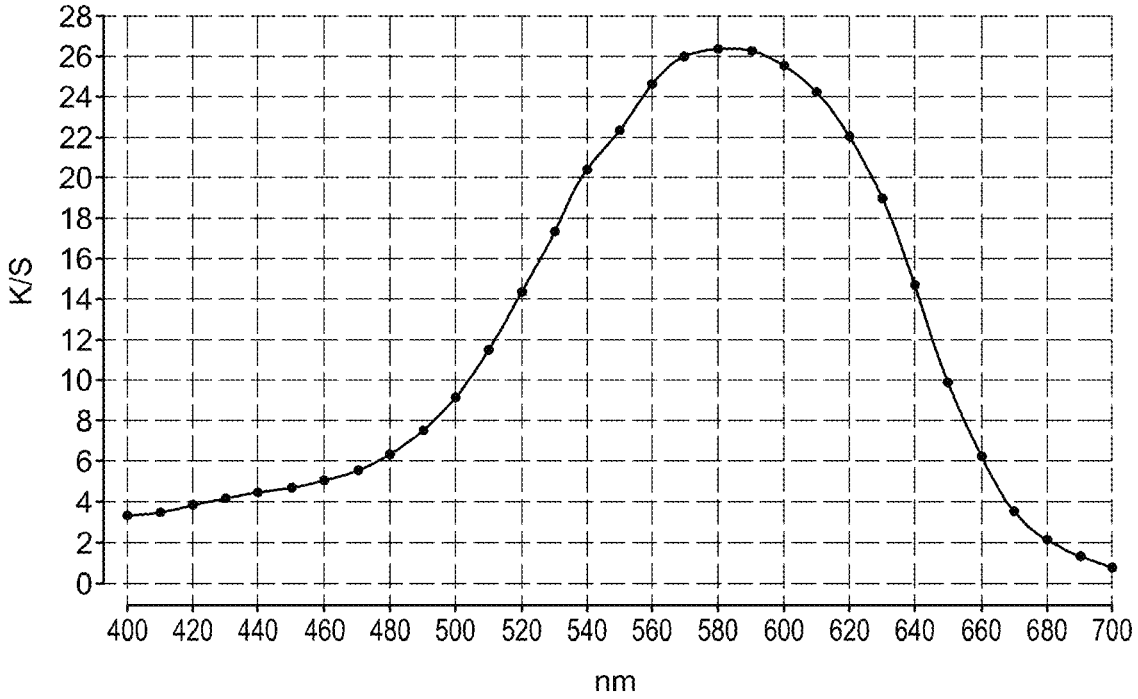
FIG. 2 shows the K/S curve of fabric made of filament PLA yarn, which fabric has been dyed navy blue using the dyeing method of the present invention.

The K/S curves of the dyed fabrics that had been dyed black or navy blue were determined. The results are shown in FIGS. 1 and 2, respectively.

Example 9

The dry and wet rub fastness of the dyed fabrics of Example 6 that had been dyed black or navy blue were determined using ISO method 105-X12:2016.

The results of the rub fastness measurements are shown in Table 7.

TABLE 7

| | Navy Blue | Black |
|---|---|---|
| Warp dry | 4/5 | 4 |
| Warp wet | 5 | 4/5 |
| Weft dry | 4/5 | 4 |
| Weft wet | 5 | 4/5 |

Example 10

The wash fastness of the dyed fabrics Example 6 that had been dyed black or navy blue was determined using ISO method 105-C06: A1M.

The results of the wash fastness measurements are shown in Table 8.

TABLE 8

| | Navy Blue | Black |
|---|---|---|
| Diacetate | 4/5 | 4 |
| Bleached cotton | 5 | 5 |
| Polyamide | 5 | 4/5 |
| Polyester | 5 | 4/5 |
| Acrylic | 5 | 5 |
| Wool | 5 | 5 |

Comparative Example

Yarn made of PLA (NM20 ex Die Spinnerei Neuhof, Germany) was dyed using an aqueous dyeing medium (110° C., 45 minutes).

The weight averaged molecular weight of the PLA in the dyed and undyed yarn was determined by means of gel permeation chromatography. The results are summarized in Table 9.

TABLE 9

| | Weight averaged molecular weight ($M_w$) in kg/mol |
|---|---|
| Undyed | 101 |
| PE-3325 | 56 |

The invention claimed is:

1. A dyed substrate comprising at least 70 wt. % of dyed PLA-fibres having a poly(lactic) acid content of at least 70 wt. %, the dyed substrate having a total poly(lactic) acid content of at least 70 wt. %, wherein the dyed PLA-fibres are dyed with one or more disperse dyes and wherein the dyed substrate has the following CIELAB colour:

$$0 \leq L^* \leq 25;$$

$$-5 \leq a^* \leq 5;$$

$$-5 \leq b^* \leq 5.$$

2. The dyed substrate according to claim 1, wherein the dyed substrate has an L* colour value that does not exceed 20.

3. The dyed substrate according to claim 1, wherein the maximum K/S value of the dyed substrate in the wavelength range of 400 to 700 nm is at least 20.

4. The dyed substrate according to claim 1, wherein the dyed substrate has an average K/S value in the range of 420 nm to 640 nm of at least 20.

5. The dyed substrate according to claim 1, wherein the dyed substrate has a reflectance at 600 nm of less than 25%, the reflectance being determined by Spectrophotometer under Illuminant D65/10 degrees (outdoor daylight).

6. The dyed substrate according to claim 1, wherein the dyed substrate has a wet rub fastness of at least 4 as determined by ISO 105-X12:2016.

7. The dyed substrate according to claim 1, wherein the dyed substrate has a wash fastness of at least 4 as determined by ISO 105-C06:2010.

8. The dyed substrate according to claim 1, wherein the substrate comprises a PLA-yarn that contains the dyed PLA-fibres, said PLA-yarn having an elongation at break of less than 60% as determined by ISO method 2062.

9. The dyed substrate according to claim 1, wherein the poly(lactic acid) has an average molecular weight (Mw) of at least 50 kg/mol.

10. The dyed substrate according to claim 1, wherein at least 98 wt. % of the poly(lactic acid is poly-(L-lactic acid).

11. A method of preparing a dyed substrate comprising at least 70 wt. % of dyed PLA-fibres having a poly(lactic) acid content of at least 70 wt. %, the dyed substrate having a total poly(lactic) acid content of at least 70 wt. %, wherein the dyed PLA-fibres are dyed with one or more disperse dyes and wherein the dyed substrate has the following CIELAB colour:

$$0 \le L^* \le 25;$$

$$-128 \le a^* \le 10;$$

$$-128 \le b^* \le 128,$$

said method comprising:

providing a substrate comprising at least 70 wt. % of fibres having a poly(lactic) acid content of at least 70 wt. %, said substrate having a total poly(lactic) acid content of at least 70 wt. %;

introducing the substrate into a dyeing chamber;

passing a stream of dyeing medium through the dyeing chamber containing the substrate during a period of 30 to 300 minutes to produce a dyed substrate, said dyeing medium having a pressure of 12-50 MPa and a temperature of 70-100° C., and comprising at least 80 wt. % of supercritical carbon dioxide, one or more disperse dyes and less than 3 wt. % water;

wherein the disperse dye is employed in a concentration of 0.2-3% by weight of substrate; and wherein the dyeing conditions employed during the dyeing period meet the following condition:

$$W_{CO2}/W_{dye} \ge 100 \text{ kg/g}$$

wherein:

$W_{CO2}$ represents the total mass of supercritical dioxide that is passed through the dyeing chamber during the dyeing period, expressed in kg;

$W_{dye}$ represents the total amount of disperse dye that is retained in the dyed substrate after the dyeing period, expressed in g.

12. The method according to claim 11, wherein 200 kg/g≤$W_{CO2}/(W_{dye})$≤10,000 kg/g.

13. The method according to claim 11, wherein the disperse dye is employed in a concentration of 0.3-2.5% by weight of substrate.

14. The method according to claim 11, wherein the dyeing medium is produced by passing a stream containing at least 90 wt. % of supercritical carbon dioxide through a container holding disperse dye and subsequently passing a stream of the dyeing medium so obtained through the dyeing chamber.

15. The method according to claim 11, wherein the method produces a dye substrate having the following CIELAB color:

- $0 \le L* \le 25;$
- $-5 \le a* \le 5;$
- $-5 \le b* \le 5.$

16. The dyed substrate according to claim 4, wherein the dyed substate has an average K/S value in the range of 420 nm to 640 nm of at least 22.

17. The dyed substrate according to claim 5, wherein the dyed substrate has a reflectance at 600 nm of less than 10%, the reflectance being determined by Spectrophotometer under Illuminant D65/10 degrees (outdoor daylight).

* * * * *